US006351619B1

(12) United States Patent
Yamada

(10) Patent No.: US 6,351,619 B1
(45) Date of Patent: Feb. 26, 2002

(54) IMAGE FORMING APPARATUS, BELT TYPE FIXING DEVICE AND HEATING CONTROL

(75) Inventor: Masamichi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/556,521

(22) Filed: Apr. 21, 2000

(30) Foreign Application Priority Data

Apr. 23, 1999 (JP) ..... 11-116227

(51) Int. Cl.[7] ..... G03G 15/20
(52) U.S. Cl. ..... 399/70; 399/329
(58) Field of Search ..... 399/329, 307, 399/69, 70; 219/216

(56) References Cited

U.S. PATENT DOCUMENTS 4,095,886 A * 6/1978 Koeleman et al. ..... 399/308
4,163,892 A * 8/1979 Komatsu et al. ..... 219/216
4,565,439 A * 1/1986 Reynolds ..... 399/329
5,697,036 A * 12/1997 Moser ..... 399/329
5,890,047 A * 3/1999 Moser ..... 399/329
6,088,549 A * 7/2000 Kagawa et al. ..... 399/67
6,226,488 B1 * 5/2001 Maeyama ..... 399/322

FOREIGN PATENT DOCUMENTS

| | | |
|---|---|---|
| DE | 44 07 931 C2 | 1/1996 |
| EP | 0 929 016 A2 | 7/1999 |
| JP | 9-138597 | 5/1997 |
| JP | 10-78725 | 3/1998 |

* cited by examiner

*Primary Examiner*—Robert Beatty
(74) *Attorney, Agent, or Firm*—Oblon, Spivak, McClelland, Maier & Neustadt, P.C.

(57) ABSTRACT

A belt type fixing device of the present invention includes an endless belt, a conveyor roller supporting the belt such that the belt is rotatable, a first heat source for heating the belt, a first temperature sensor, a press roller for pressing a recording medium against the belt, a hollow roller contacting the outer surface of the belt, a second heat source disposed in or adjoining the hollow roller and a second temperature sensor. The fixing device is capable of reducing a warm-up time and preventing the belt from being adhered to the hollow roller by toner and damaged.

7 Claims, 6 Drawing Sheets

IMAGE FORMING APPARATUS, BELT TYPE FIXING DEVICE AND HEATING CONTROL

BACKGROUND OF THE INVENTION

The present invention relates to a laser beam printer, digital copier, facsimile apparatus using plain papers or similar image forming apparatus and more particularly to a belt type fixing device included in an image forming apparatus.

An image forming apparatus includes a fixing device for fixing a toner image formed on a paper or similar recording medium. While the fixing device has traditionally been implemented by a heat roller, a film heating type fixing device, a belt type fixing device, other fixing devices including an electromagnetic induction type fixing device and a resistance heating type fixing device are available today.

The fixing device of the type using a heat roller is feasible for a full-color image formed on a paper by much toner and requiring the surface of the paper to be glossy. The heat roller is made up of a hollow metallic core, an elastic member covering the core, and a surface layer covering the elastic member and having a high parting ability. A heat source is disposed in the core and implemented by a halogen heater. However, a substantial warm-up time is necessary for the surface of the heat roller to be heated from the initial environment temperature to the expected heating temperature. This is because the core has a great thermal capacity and because a substantial period of time is necessary for heat to reach the surface layer via the elastic member. The fixing device lacks a quick starting ability.

On the other hand, a belt type fixing device is usually applied to a laser beam printer, digital copier, facsimile apparatus using plain papers or similar image forming apparatus. This type of fixing device is applicable even to other apparatuses as a device for heating a paper while conveying it. Japanese Patent Laid-Open Publication No. 9-212031, for example, discloses a fixing device including an endless belt passed over a plurality of conveyor rollers, and a roller contacting the outer surface of the belt for applying tension to the belt or cleaning the belt. The belt has a smaller thermal capacity than the heat roller and therefore reduces the warmup time of the fixing device. There is, however, an increasing demand for an even shorter warm-up time.

Assume that a roller is held in contact with the outer surface of the belt for applying tension to the belt or cleaning the belt, as stated earlier. The problem with this configuration is that offset toner deposits on the belt and adheres the belt and roller. Such toner is driven at temperature lower than its softening point because a heat source is remote from the roller, scratching or otherwise damaging the belt.

Technologies relating to the present invention are also disclosed in, e.g., Japanese Patent Laid-Open Publication Nos. 9-138597 and 10-78725.

SUMMARY OF THE INVENTION

It is therefore an object of the present invention to provide a belt type fixing device capable of reducing the warm-up time and preventing a belt included therein from being adhered to a roller by toner and damaged.

It is another object of the present invention to provide a belt type fixing device capable of removing offset toner, paper dust and other impurities from the surface layer of a belt included therein.

It is another object of the present invention to provide a belt type fixing device capable of surely and efficiently cleaning a belt included therein.

It is another object of the present invention to provide a belt type fixing device including a hollow roller having a surface layer whose coefficient of friction is small enough to protect a belt included in the device from damage.

It is another object of the present invention to provide a belt type fixing device capable of increasing yield and reducing cost.

It is another object of the present invention to provide a belt type fixing device including a hollow roller whose surface temperature can be accurately controlled.

It is another object of the present invention to provide a belt type fixing device capable of lowering the turn-on frequency of a second heat source included therein to thereby save power.

It is another object of the present invention to provide a belt type fixing device capable of reducing the warmup time and obviating defective images ascribable to the damage of a belt included therein.

In accordance with the present invention, a belt type fixing device includes an endless belt, a conveyor roller supporting the belt such that the belt is rotatable, a first heat source for heating the belt, a press roller for pressing a recording medium against the belt, a hollow roller contacting the outer surface of the belt, and a second heat source disposed in or adjoining the hollow roller. The hollow roller is rotatable in the same direction as the belt, as seen at a position where the former contacts the latter, at a peripheral speed equal to or higher than the peripheral speed of the belt.

Also, in accordance with the present invention, a belt type fixing device includes an endless belt, a conveyor roller supporting the belt such that the belt is rotatable, a first heat source for heating the belt, a press roller for pressing a recording medium against the belt, a hollow roller contacting the outer surface of the belt, a second heat source disposed in or adjoining the hollow roller, and a temperature sensor for sensing the temperature of the surface layer included in the hollow roller. The second heat source is controlled on the basis of the temperature being sensed by the temperature sensor.

Further, in accordance with the present invention, in an image forming apparatus including a belt type fixing device, the belt type fixing device includes an endless belt, a conveyor roller supporting the belt such that the belt is rotatable, a first heat source for heating the belt, a press roller for pressing a recording medium against the belt, a hollow roller contacting the outer surface of the belt, and a second heat source disposed in or adjoining the hollow roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
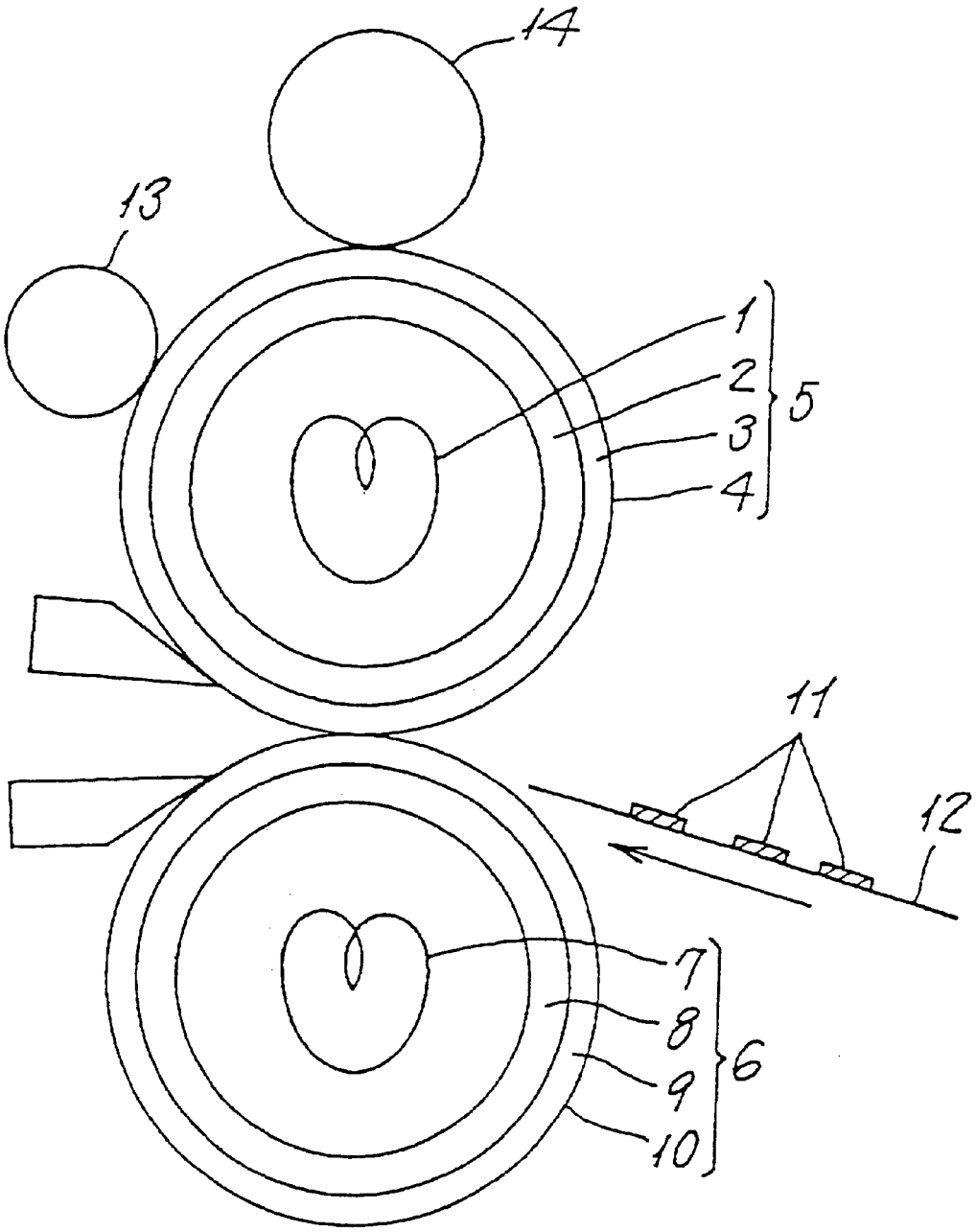
FIG. 1 PRIOR ART
FIG. 1 is a section showing a conventional heat roller type fixing device.

To better understand the present invention, brief reference will be made to a conventional heat roller type fixing device, shown in FIG. 1. As shown, the fixing device includes a heat roller 5 and a press roller 6. The heat roller 5 is made up of a hollow metallic core 2, an elastic member 3 covering the core 2, and a surface layer 4 covering the elastic member 3 and having a high parting ability. A heat source 1 is disposed in the core 2 and implemented by a halogen heater. The press roller 6, like the heat roller 5, is made up of a hollow metallic core 8, an elastic member 9 covering the core 8, and a surface layer 10 covering the elastic member 9 and having a high parting ability. A heat source or halogen heater 7 is disposed in the core 8 although it is not essential.

A paper or similar recording medium 12 carrying a toner image 11 thereon is brought to a nip between the heat roller 5 and the press roller 6. The heat roller 5 and press roller 6 fix the toner image 11 on the paper 12 with heat and pressure while conveying the paper via the above nip. A cleaning roller 13 and an oil applying roller 14 are held in contact with the heat roller 5. The cleaning roller 13 cleans the surface of the heat roller 5 while the oil applying roller 14 applies oil to the cleaned surface of the heat roller 5.

Assume that the above fixing device is applied to a color image forming apparatus capable of forming a full-color image in the form of a laminate of four toner layers at maximum. Then, the fixing device must sufficiently mix the toner of different colors by melting them with heat. For this purpose, the core 2 of the heat roller 2 is formed of metal having a great thermal capacity. Also, the elastic member 3 covering the core 3 is formed of a material capable of causing the toner image 11 to evenly melt. The toner image 11 is fixed on the paper 12 via the elastic member 3 and surface layer 4.

However, a substantial warm-up time is necessary for the surface of the heat roller 5 to be heated from the initial environment temperature to the expected heating temperature. This is because the core 2 of the heat roller 5 has a great thermal capacity and because a substantial period of time is necessary for heat to reach the surface layer 4 via the elastic member 3. The fixing device therefore cannot start operating quickly.

Further, to prevent the warm-up time from extending, the thickness of the elastic member 3 must, in many cases, be limited to a range of about 1 mm to about 3 mm. This, in turn, limits the nip width that should advantageously be broad from the fixing ability (parting ability) standpoint, and limits the downward nip configuration also desirable from the fixing ability standpoint. To guarantee the fixing ability or parting ability, the oil applying roller 14 or similar oil applying means must apply much oil, or parting agent, to the heat roller 5. Consequently, the fixing device needs frequent replacement of the oil applying means and is therefore not feasible for user maintenance. The words "downward nip configuration" mentioned above refer to a nip convex toward the image surface of the paper 12 and formed by the soft elastic member 3 of the heat roller 5 and the hard press roller 6.

On the other hand, the problem with a belt type fixing device is that offset toner deposits on a belt and adheres the belt and a roller contacting it, as stated earlier. Such toner is driven at temperature lower than its softening point because a heat source is remote from the roller, scratching or otherwise damaging the fixing belt. The present invention is a solution to this problem and will be described hereinafter with reference to the accompanying drawings.

Figure 2:
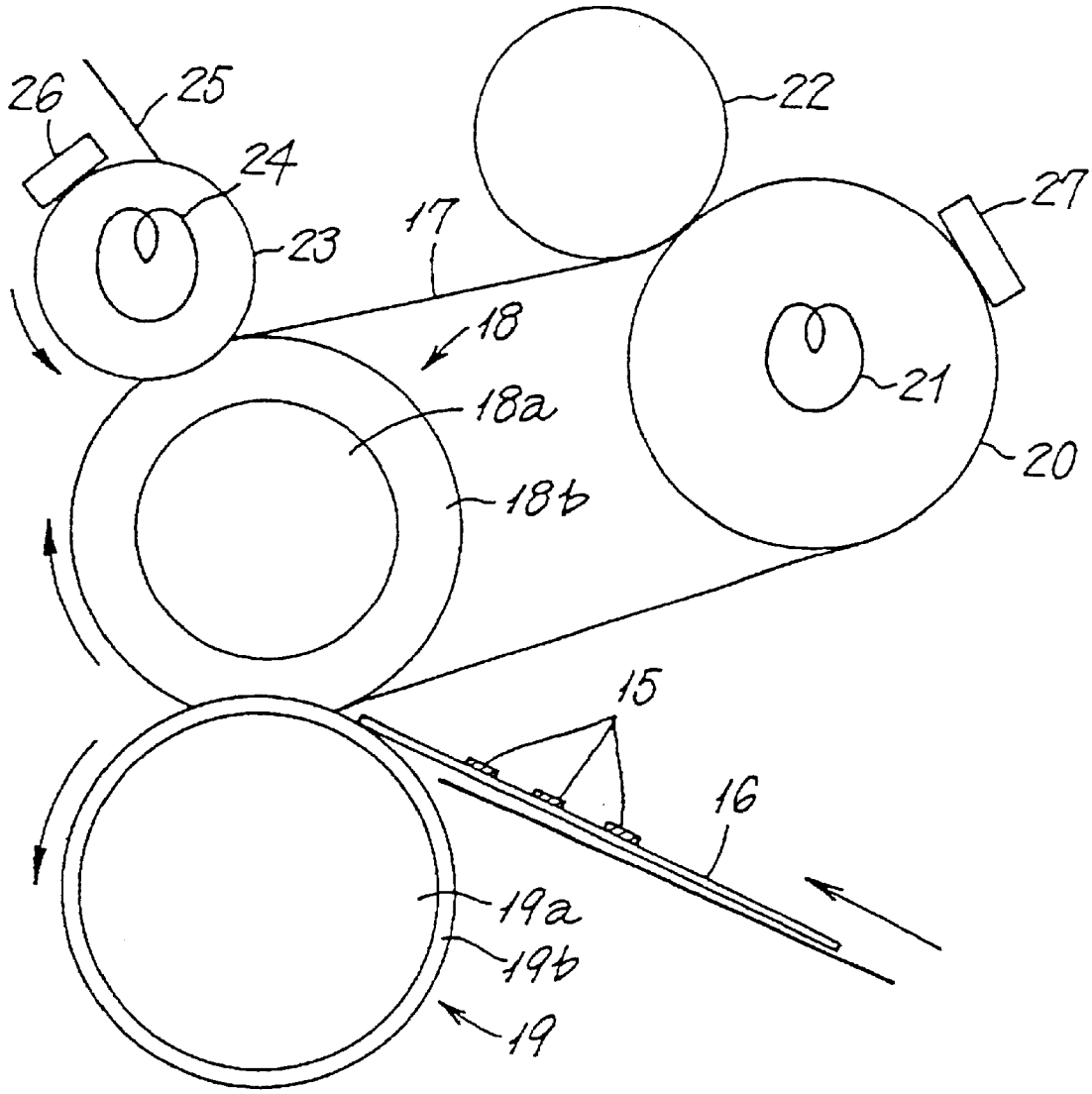
FIG. 2 is a section showing a belt type fixing device embodying the present invention.

Referring to FIG. 2, a belt type fixing device embodying the present invention is shown and includes a belt 17, a fix roller 18, and a press roller 19. The fix roller 18 and press roller 19 fix a toner image 15 carried on a paper or similar recording medium 16 with heat and pressure while conveying the paper 16 via the belt 17.

The belt 17 should preferably be a thin endless belt formed of, e.g., nickel, polyimide or similar heat-resistant resin, carbon steel or stainless steel. The surface of the belt 17 is covered with a heat-resistant parting layer implemented by, e.g., fluorocarbon resin or silicone rubber having a high parting ability. The fix roller 18 is made up of a metallic core 18*a* and a heat-insulating elastic member 18*b* covering the core 18*a*. The elastic member 18*b* is formed of foam silicone rubber or similar soft heat-resistant material in order to provide the nip between the fix roller 18 and the press roller 19 with a sufficient width. The elastic member 18*b* has sufficient thickness. In the illustrative embodiment, the thickness of the elastic member 18*b* is about 15% to 20% of the diameter of the fix roller 18.

The press roller 19 is made up of a metallic core 19*a* formed of aluminum, stainless steel, carbon steel or similar metal and a surface layer 19*b* covering the core 19*a*. The core 19*a* may be hollow and accommodate a halogen heater or similar heat source therein, if desired. The surface layer 19*b* has a high parting ability and is made of fluorocarbon resin or silicone rubber having a high parting ability by way of example. The illustrative embodiment forms a downward nip configuration in order to promote the release of the paper 16 from the belt 17. That is, the press roller 19 has high hardness. More specifically, the surface layer 19*b* of the press roller 19 has thickness less than 7% of the diameter of the press roller 19, while the surface layer 19*b* has hardness higher than 40 Hs, as measured by JIS (Japanese Industrial Standards) A scale.

The belt 17 is passed over the fix roller or conveyor roller 18 for conveying the belt 17 and a heat roller 20. A drive source, not shown, causes the belt 17 to turn. The heat roller 20 is implemented by a hollow cylinder having a thin wall and formed of aluminum, carbon steel, stainless steel or similar metal. A halogen heater or similar heat source 21 is disposed in the heat roller 20 and heats the belt 17 via the heat roller 20. An applicator roller or applying means 22 is rotatable in contact with the outer surface of the belt 17 for applying silicone oil or similar parting agent to the belt 17.

A roller 23 is also rotatable in contact with the outer surface of the belt 17 and implemented as a hollow cylinder having a thin wall. The roller 23 is formed of aluminum, carbon steel, stainless steel or similar metal. A halogen heater or similar heat source 24 is disposed in the roller 23 so as to heat the roller 23. Alternatively, the heat source 24 may be located in the vicinity of the roller 23 for heating it, if desired. Further, the roller 23 may be formed of metal of the kind generating heat due to electromagnetic induction, in which case the heat source 24 will be implemented as magnetic field generating means for heating the roller 23. Moreover, the heat source 24 implemented by a halogen heater may be located in the vicinity of the roller 23 so as to heat it indirectly via a reflector.

In the above construction, the heat source 21 over which the belt 17 is passed heats the belt 17 via the heat roller 20. In addition, the heat source 24 positioned outside of the belt 17 heats the belt 17 via the hollow roller 23. This is successful to reduce the warm-up time. Further, because the heat source 24 heats the roller 23, offset toner deposited on the roller 23 is heated to a temperature higher than its softening point. This obviates an occurrence that offset toner adheres the belt 17 and roller 23 and damages the belt 17.

The roller 23 removes offset toner, paper dust and other impurities from the surface of the belt 17 and, in this sense, plays the role of a cleaning roller. A scraper 25 is held in contact with the roller 23 for scraping off the above impurities collected by the roller 23.

A driveline, not shown, causes the roller 23 to rotate in the same direction as the belt 17, as seen at a position where the former contacts the latter. The roller 23 rotates at a peripheral speed equal to or slightly higher than the peripheral speed of the belt 17. The roller 23 therefore exerts a drive force and moves at a linear velocity different from the linear velocity of the belt 17, so that the cleaning ability of the roller 23 is enhanced.

The roller 23 has its surface covered with a heat-resistant parting layer. The parting layer reduces the coefficient of friction of the surface of the roller 23 and thereby protects the belt 17 from damage ascribable to the sliding contact of the belt 17 with the roller 23. Further, the parting layer is formed of fluorocarbon resin in order to reduce cost. In addition, fluorocarbon resin is easily available at low cost in the industrial aspect and has high yield.

A thermistor or similar temperature sensing means 26 is responsive to the temperature of the surface of the surface layer or surface of the roller 23. A controller, which will be described later, selectively turns on or turns off the heat source 24, depending on whether or not the output of the thermistor 26 is representative of a temperature higher than a second preselected temperature. That is, the controller so controls the heat source 24 as to maintain the temperature being sensed by the thermistor 26 at the second temperature. This is successful to accurately control the temperature of the surface layer of the roller 23.

A thermistor or similar temperature sensing means 27 is responsive to the temperature of the surface of the surface layer or surface of the belt 17. The controller selectively turns on or turns off the heat source 21, depending on whether or not the output of the thermistor 27 is representative of a temperature higher than a first preselected temperature. That is, the controller so controls the heat source 21 as to maintain the temperature being sensed by the thermistor 27 at the first temperature. The first temperature is higher than or equal to the second temperature. The surface layer of the roller 23 is therefore lower in temperature than the surface layer of the belt 17. This reduces the turn-on frequency of the heat source 24 in a repeat print mode and thereby saves power.

The second temperature is selected to be higher than the softening point of toner. The controller controls the heat source 24 such that the temperature being sensed by the thermistor 26 remains above the softening point of the toner. In this condition, offset toner deposited on the roller 23 is heated to a temperature higher than its softening point. Consequently, the belt 17 is prevented from being adhered to the roller 23 by the offset toner and damaged.

Figure 3:
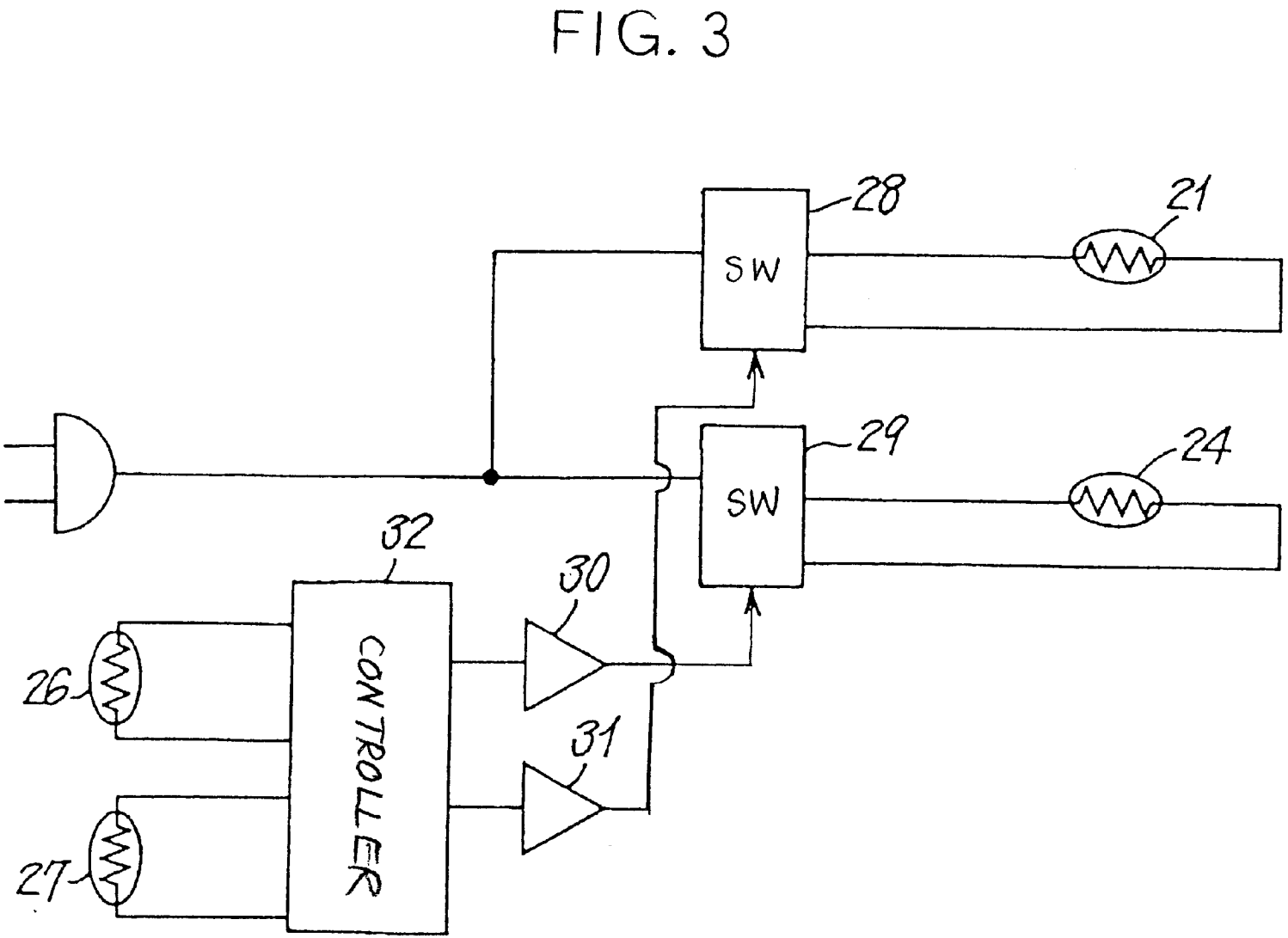
FIG. 3 is a block diagram schematically showing an electrical arrangement included in the illustrative embodiment.

FIG. 3 shows an electrical circuit arrangement included in the illustrative embodiment. As shown, the heat sources 21 and 24 are connected to a commercially available power supply via switches (SWs) 28 and 29, respectively. Drivers 31 and 30 drive the switches 28 and 29, respectively. A controller or control means 32 controls the drivers 30 and 31 in accordance with the outputs of the thermistors 26 and 27, respectively, thereby turning on or turning off the switches 28 and 29.

Figure 4:
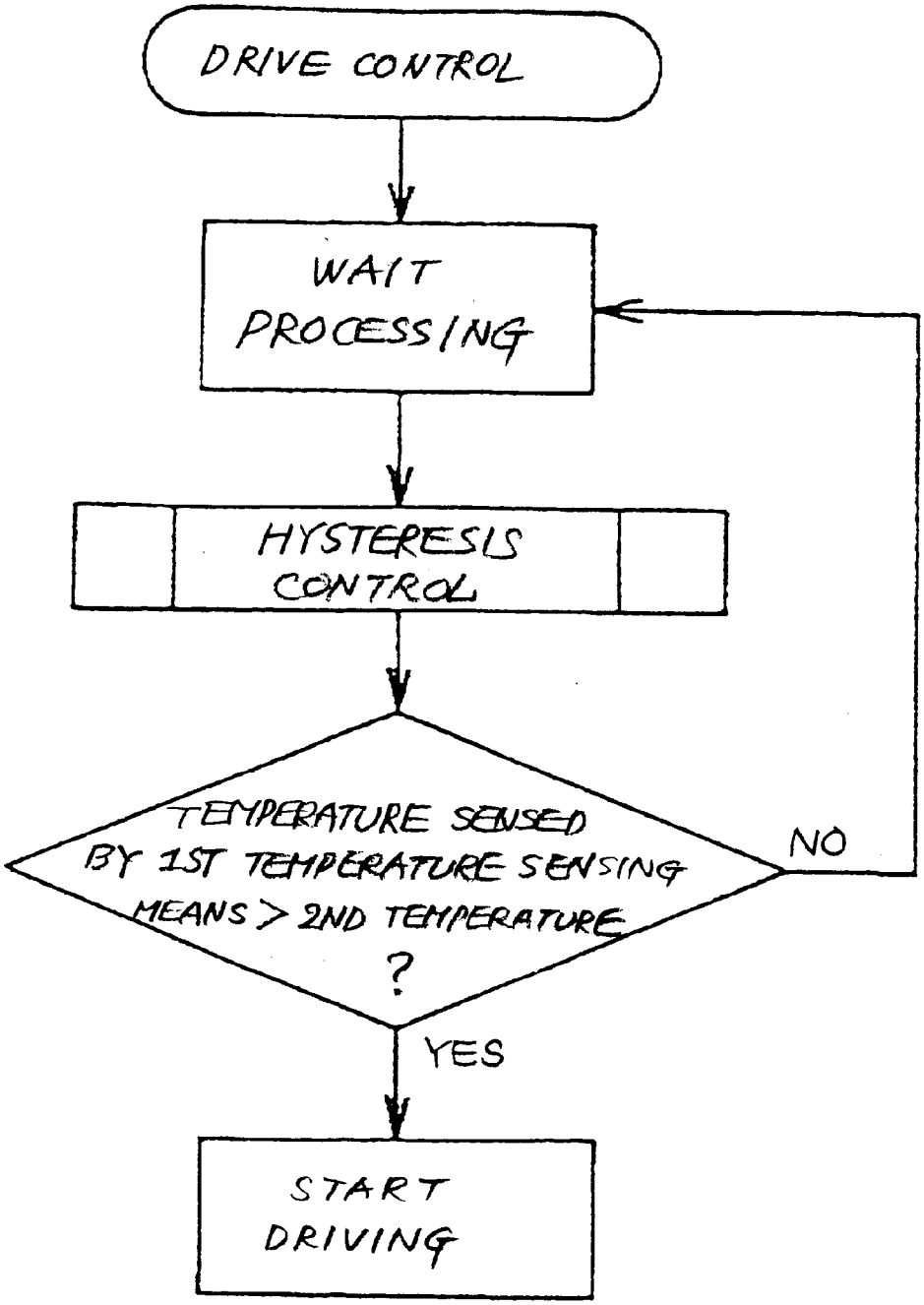
FIG. 4 is a flowchart demonstrating a specific operation of the illustrative embodiment.

FIG. 4 shows a specific operation of the controller 32. As shown, in response to a drive command for driving the fixing device, the controller 32 does not drive the fixing device immediately, but executes wait processing. Specifically, when the illustrative embodiment is applied to an image forming apparatus, the wait processing inhibits the paper 16 with the toner image 15 from being fed to the fixing device.

Figure 5:
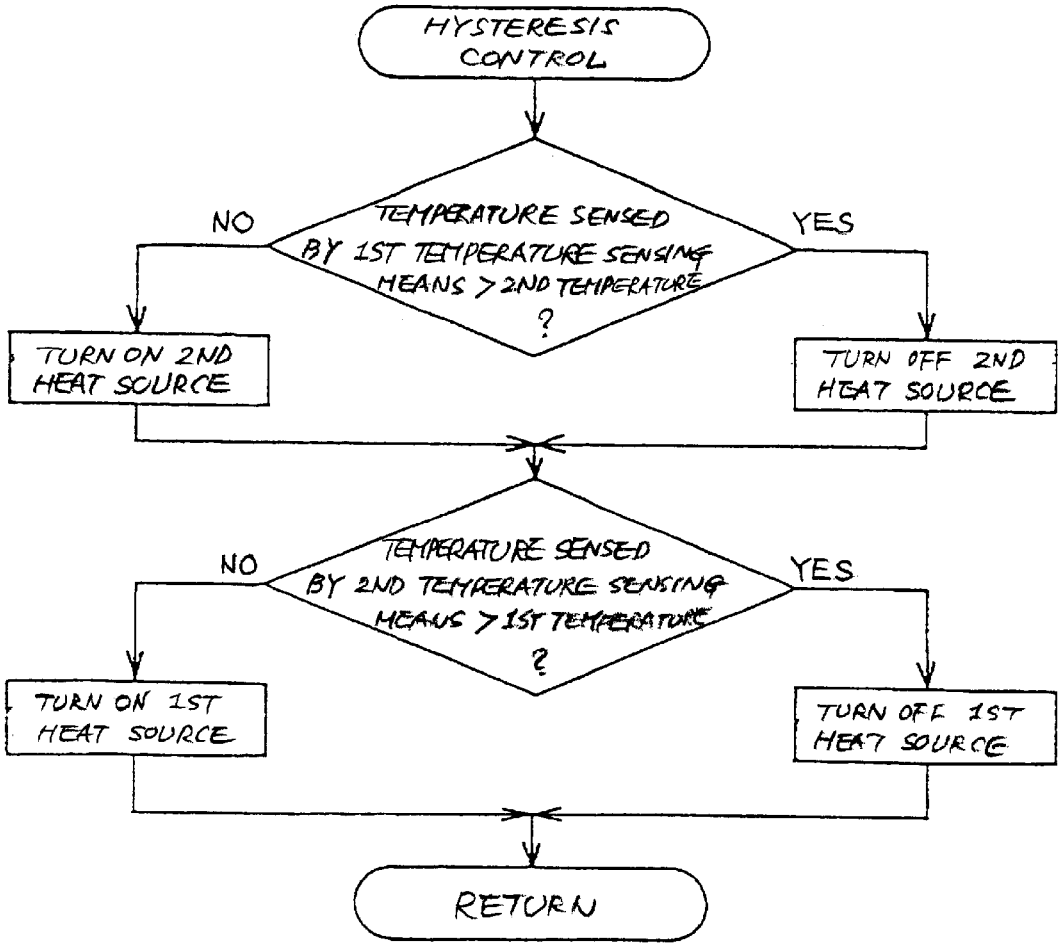
FIG. 5 is a flowchart showing hysteresis control included in the operation of FIG. 4 in detail.

Subsequently, the controller 32 executes hysteresis control. FIG. 5 demonstrates the hysteresis control in detail. As shown, the controller 32 selectively turns on or turns off the heat source 21 such that the surface temperature of the belt 17 rises to and remains at the first temperature. Also, the controller 32 selectively turns on or turns off the heat source 24 such that the surface temperature of the heat roller 23 rises to and remains at the second temperature. More specifically, the controller 32 determines whether or not the surface temperature of the belt 17 being sensed by the thermistor 27 is higher than the first temperature, and controls the driver 31 on the basis of the result of decision so as to turn on or turn off the heat source 21. Consequently, the surface temperature of the belt 17 is raised to the first temperature and held thereat.

Further, the controller 32 determines whether or not the surface temperature of the roller 23 being sensed by the thermistor 26 is higher than the second temperature and controls the driver 30 on the basis of the result of decision so as to turn on or turn off the heat source 24. The surface temperature of the roller 23 is therefore raised to the second temperature and held thereat.

When the surface temperature of the roller 23 is lower than the second temperature, the controller 32 repeats the wait processing and hysteresis control. As soon as the surface temperature of the roller 23 rises above the second temperature, the controller 32 starts the drive of the fixing device, i.e., drivelines assigned to the belt 17 and roller 23. The controller 32 then repeats the hysteresis control in order to maintain the belt 17 and roller 23 at the first temperature and second temperature, respectively.

With the above procedure, the controller 32 does not start driving the fixing device until the surface temperature of the roller 23 rises above the second temperature, i.e., until toner deposited on the roller 23 reaches its softening point. This surely prevents the belt 17 from being adhered to the roller 23 by the above toner and damaged.

Figure 6:
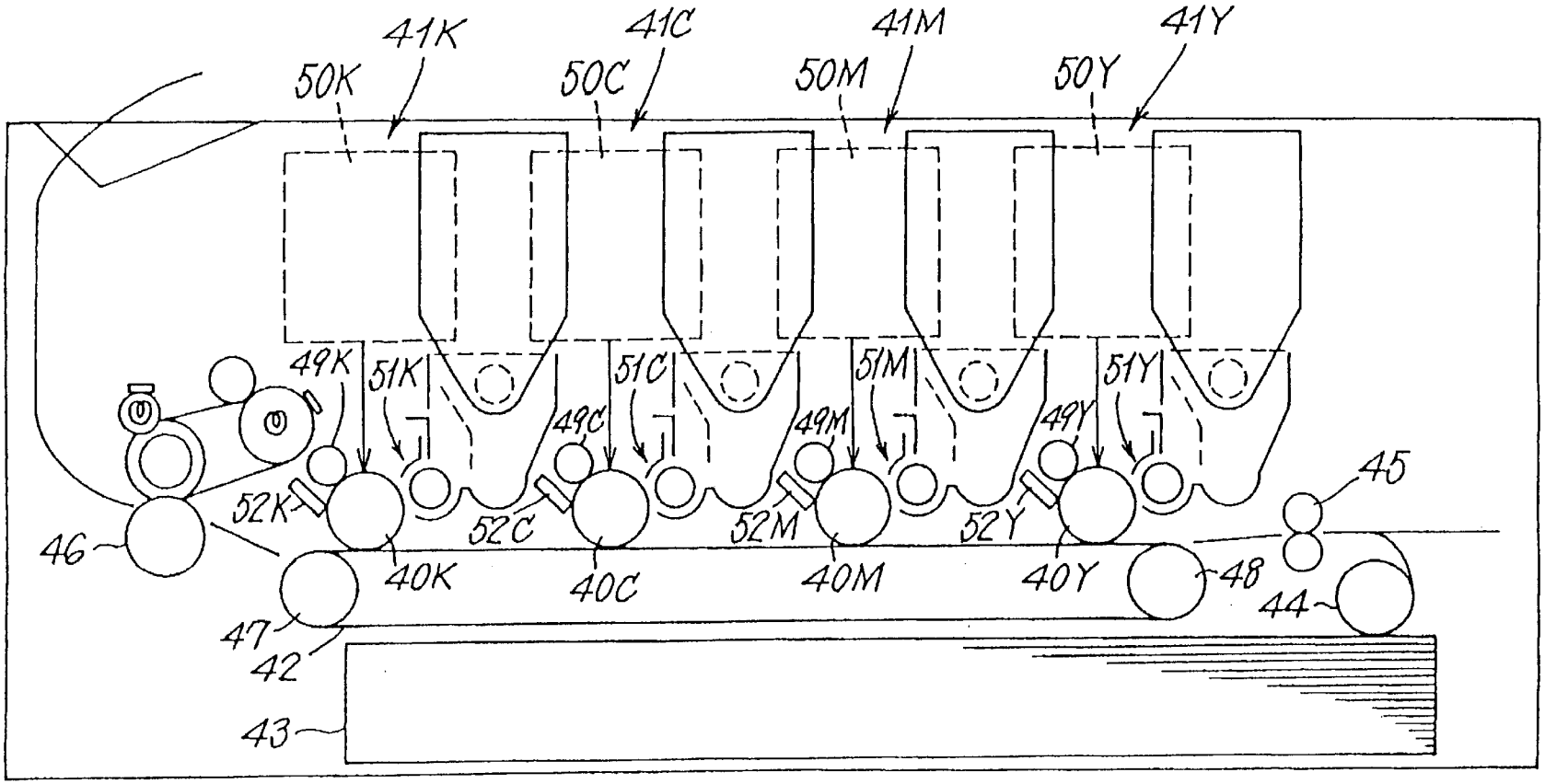
FIG. 6 is a view showing a specific configuration of an image forming apparatus to which the illustrative embodiment is applied.

Referring to FIG. 6, a specific configuration of a color image forming apparatus to which the above embodiment is applied is shown. As shown, the apparatus includes image forming sections 41Y (yellow), 41M (magenta), 41C (cyan) and 41K (black) for respectively forming a Y, an M, a C and a K toner image on photoconductive elements 40Y, 40M, 40C and 40K. The photoconductive elements 40Y through 40K are implemented as drums by way of example. An endless conveyor belt 42 conveys a paper or similar recording medium. A paper feed section includes a cassette 43 loaded with a stack of papers and a pickup roller 44. The pickup roller 44 pays out a paper from the cassette 43 toward a registration roller pair 45. Transfer chargers or transferring means, not shown, each are associated with one of the image forming sections 41Y through 41K. The transfer chargers sequentially transfer toner images of different colors from the drums 40Y through 40K to the above paper one above the other. A fixing device 46 of the illustrative embodiment fixes the resulting composite color image on the paper.

The conveyor belt 42 is passed over a plurality of rollers 47 and 48 and caused to turn by a drive source not shown. The drums 40Y through 40K are rotated by a drum drive section not shown. Chargers 49Y, 49M, 49C and 49K uniformly charge the surfaces of the drums 40Y, 40M, 40C and 40K, respectively. Writing units or laser optics 50Y, 50M, 50C and 50K respectively expose the charged surfaces of the drums 40Y, 40M, 40C and 40K and thereby form latent images thereon. Developing units 51Y, 51M, 51C and 51K respectively develop the latent images formed on the drums 40Y, 40M, 40C and 40K with Y, M, C and K toner, thereby forming a Y, an M, a C and a K toner image.

The registration roller pair 45 starts conveying the paper fed from the cassette 43 at such a timing that the leading edge of the paper sequentially meets the leading edges of the toner images formed on the drums 40Y through 40K. The conveyor belt 42 conveys the paper fed from the registration roller pair 45 via the drums 40Y through 40K. The transfer chargers mentioned earlier transfer the toner images from the drums 40Y through 40K to the paper one above the other, completing a full-color image on the paper. The fixing device 46 fixes the full-color image on the paper. Subsequently, the paper with the fixed image, i.e., a print is driven out of the apparatus.

After the image transfer, drum cleaning derives 52Y, 52M, 52C and 52K removes the toner left on the drums 40Y, 40M, 40C and 40K, respectively.

Because the warm-up time of the fixing device 46 is short, it reduces the startup time of the entire apparatus and obviates defective images ascribable to the damage of the belt 17.

In summary, it will be seen that the present invention provides a belt type fixing device having various unprecedented advantages, as enumerated below.

(1) The fixing device reduces a warm-up time and prevents a belt included therein from being adhered to a roller by toner and damaged.

(2) The fixing device is capable of removing offset toner, paper dust and other impurities from the surface layer of a belt included therein.

(3) The fixing device is capable of surely and efficiently cleaning the belt.

(4) The roller has a surface layer whose coefficient of friction is small enough to protect the belt from damage.

(5) The fixing device increases yield and reduces cost.

(6) The surface temperature of the roller can be accurately controlled.

(7) The turn-on frequency of a second heat source is lowered to thereby save power.

(8) The short warm-up time obviates defective images ascribable to the damage of the belt.

Various modifications will become possible for those skilled in the art after receiving the teachings of the present disclosure without departing from the scope thereof.

What is claimed is:

1. A belt type fixing device comprising:

an endless belt;

a conveyor roller supporting said belt such that said belt is rotatable;

a first heat source for heating said belt;

a press roller for pressing a recording medium against said belt;

a hollow roller contacting an outer surface of said belt, wherein said hollow roller is rotatable in a same direction as said belt, as seen at a position where said hollow roller and said belt contact each other, at a peripheral speed equal to or higher than a peripheral speed of said belt;

a second heat source disposed in or adjoining said hollow roller;

a controller configured to control a driving of said fixing device and said hollow roller, wherein said fixing device and said hollow roller are not driven until a surface layer, included in said hollow roller, reaches at least a temperature higher than a softening point of toner;

first temperature sensing means for sensing a temperature of a surface layer included in said hollow roller, wherein said second heat source is controlled on the basis of the temperature being sensed by said first temperature sensing means; and second temperature sensing means for sensing a temperature of a surface layer included in said belt, wherein said first heat source is so controlled as to cause the temperature being sensed by said second temperature sensing means to coincide with a first preselected temperature while said second heat source is so controlled as to cause the temperature being sensed by said first temperature sensing means to coincide with a second preselected temperature lower than or equal to said first preselected temperature.

2. The fixing device as claimed in claim 1, wherein said surface layer of said hollow roller is a heat-resistant parting layer.

3. The fixing device as claimed in claim 2, wherein said heat-resistant parting layer comprises a fluorocarbon resin.

4. A belt type fixing device comprising:

an endless belt;

a conveyor roller supporting said belt such that said belt is rotatable;

first heat source for heating said belt;

a press roller for pressing a recording medium against said belt;

a hollow roller contacting an outer surface of said belt;

a second heat source disposed in or adjoining said hollow roller;

a controller configured to control a driving of said fixing device and said hollow roller, wherein said fixing device and said hollow roller are not driven until a surface layer, included in said hollow roller, reaches at least a temperature higher than a softening point of toner;

first temperature sensing means for sensing a temperature of a surface layer included in said hollow roller, wherein said second heat source is controlled on the basis of the temperature being sensed by said first temperature sensing means; and second temperature sensing means for sensing a temperature of a surface layer included in said belt, wherein said first heat source is so controlled as to cause the temperature being sensed by said second temperature sensing means to coincide with a first preselected temperature while said second heat source is so controlled as to cause the temperature being sensed by said first temperature sensing means to coincide with a second preselected temperature lower than or equal to said first preselected temperature.

5. The fixing device as claimed in claim 4, wherein said second heat source is controlled such that the temperature being sensed by said first temperature sensing means is higher than a softening point of toner.

6. In an image forming apparatus including a belt type fixing device, said belt type fixing device comprising an endless belt;

a conveyor roller supporting said belt such that said belt is rotatable;

first heat source for heating said belt;

a press roller for pressing a recording medium against said belt;

hollow roller contacting an outer surface of said belt;

second heat source disposed in or adjoining said hollow roller;

a controller configured to control a driving of said fixing device and said hollow roller, wherein said fixing device and said hollow roller are not driven until a surface layer, included in said hollow roller, reaches at least a temperature higher than a softening point of toner;

first temperature sensing means for sensing a temperature of a surface layer included in said hollow roller, wherein said second heat source is controlled on the basis of the temperature being sensed by said first temperature sensing means; and second temperature sensing means for sensing a temperature of a surface layer included in said belt, wherein said first heat source is so controlled as to cause the temperature being sensed by said second temperature sensing means to coincide with a first preselected temperature while said second heat source is so controlled as to cause the temperature being sensed by said first temperature sensing means to coincide with a second preselected temperature lower than or equal to said first preselected temperature.

7. The image forming apparatus as claimed in claim 6, wherein said hollow roller is rotatable in a same direction as said belt, as seen at a position where said hollow roller and said belt contact each other, at a peripheral speed equal to or higher than a peripheral speed of said belt.

* * * * *